United States Patent [19]

Spatafora et al.

[11] Patent Number: 5,016,423

[45] Date of Patent: May 21, 1991

[54] METHOD AND A DEVICE FOR FOLDING THE ENDS OF TUBULAR WRAPPINGS

[75] Inventors: Mario Spatafora; Bruno Grandi; Antonio Gamberini, all of Bologna, Italy

[73] Assignee: G.D. Societa Per Azioni, Bologna, Italy

[21] Appl. No.: 434,712

[22] Filed: Nov. 13, 1989

[30] Foreign Application Priority Data

Nov. 14, 1988 [IT] Italy ..... 3660 A/88

[51] Int. Cl.[5] ..... B65B 7/16

[52] U.S. Cl. ..... 53/476; 53/465; 53/480; 53/372.8

[58] Field of Search ..... 53/465, 480, 210, 380, 53/476

[56] References Cited

U.S. PATENT DOCUMENTS

| | | | |
|---|---|---|---|
| 914,578 | 3/1909 | Johnston | 53/380 X |
| 1,180,984 | 4/1916 | Day | 53/380 X |
| 1,545,513 | 7/1925 | Peters | 53/380 X |
| 1,748,594 | 2/1930 | Wheeler | 53/380 X |
| 2,533,993 | 12/1950 | Bryans | 53/380 |

*Primary Examiner*—John Sipos

*Attorney, Agent, or Firm*—Cushman, Darby & Cushman

[57] ABSTRACT

The ends of a tubular wrapper are gathered up and folded flat utilizing a method and a device whereby a first actuator flattens a first portion of the projecting endmost strip against the corresponding end surface of the commodity enveloped by the wrapper, whereupon the remainder of the strip is folded in successive portions by respective second folders, carried frontally on the periphery of a disk and engaging the strip epicyclically, the disk itself being rotated about an axis offset from and parallel to the wrapper axis, while orbiting about the wrapper axis at the same time.

11 Claims, 3 Drawing Sheets

METHOD AND A DEVICE FOR FOLDING THE ENDS OF TUBULAR WRAPPINGS

BACKGROUND OF THE INVENTION

The invention relates to a method of folding the ends of tubular wrappings.

Conventionally, a wide variety of commodities such as candy, pastilles, cookies, etc. are stacked in units of given number and conveyed into a wrapping machine by which each such stack is enveloped in a sheet of wrapping material; more exactly, the sheet is cut to a length greater than that of the stacked contents and formed into a tubular wrapper around them in such a way as to project beyond the two end surfaces, whereupon the projecting ends are folded in and flattened against these same two surfaces to form the ends of the finished wrapping.

Prior art methods of effecting the end folds in such wrappers consist essentially in rolling the enveloped commodity though a distance equal to the developable length of its transverse surface in such a way as to engage a succession of helically shaped fixed folding elements distributed along the rolling path, by which respective portions of the projecting end of the wrapper are progressively folded against the end of the enveloped commodity, part in direct contact with the end surface of the enveloped commodity, and part overlapping an area of the portion previously folded.

In order to gather the projecting end of a tubular wrapping in such a way that the corresponding end of the package will be both airtight and acceptable in terms of appearance, a significant number of single folds must be made (generally five, in the case of a cylindrical pack); moreover, each of the single folds must be made correctly. Given that, in prior art methods, these folds are effected along a rolling path equal in length to the developable circumference of the wrapping, as mentioned above, it happens that when this developable length is significantly reduced, the number of fixed folders that can be utilized, hence the number of single folds obtainable, must necessarily fall short of the minimum number effectively acceptable.

The result of such a situation is that commodities of relatively limited transverse dimensions tend to produce a package in which the ends of the tubular wrapping appear simply crumpled, and exhibit an irregular, angular profile. The object of the present invention is to overcome the difficulties encountered in gathering the ends of tubular wrappings, as outlined above, through the provision of a method whereby it can be ensured that each of the single folds is correctly made, irrespective of the transverse dimensions of the commodity to be packaged.

SUMMARY OF THE INVENTION

The stated object is achieved in a method according to the present invention, by means of which to fold the endmost projecting strip of a tubular wrapper into contact with the corresponding end surface of a commodity enveloped by the wrapper.

Such a method comprises the steps of utilizing first folding means to flatten a first portion of the projecting strip against the end surface of the commodity in such a way as to cover an area that extends through an angle less than 180° around a first axis coinciding with an axis of the wrapper, and utilizing a plurality of second folding means to flatten a succession of respective further portions of the projecting strip against the end surface.

According to the invention, the second folding means are distributed about a second axis, parallel to the first axis and coinciding with the axis of rotation of a support by which the second folding means are carried in a position facing the end surface of the commodity in such a way as enables them to be brought singly and successively into contact with the further portions of the projecting strip by causing the support to rotate about the second axis and orbit about the first axis, at one and the same time.

As the support used in implementing such a method can be of any given transverse dimensions, in order to permit of carrying greater or lesser numbers of second folding means, and can both rotate about its own axis and orbit about the wrapper axis at any given speed, the number of folds effected in each projecting end of the wrapper remains completely independent of the transverse dimensions of the commodity.

The present invention relates also to a device for the implementation of the method summarized above; such a device comprises first folders, serving to flatten a first portion of the endmost projecting strip against the end surface of the commodity in such a way as to cover an area extending through an angle less than 180° around a first axis coinciding with an axis of the wrapper; a plurality of second folders serving to flatten a succession of further portions of the projecting strip against the end surface; a rotatable disk disposed facing the projecting end of the wrapper and carrying the second folders, which are distributed around a second axis parallel to the first axis and directed toward the end surface of the commodity; and drive means by which the disk is caused both to rotate about the second axis and to orbit about the first axis at one and the same time.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
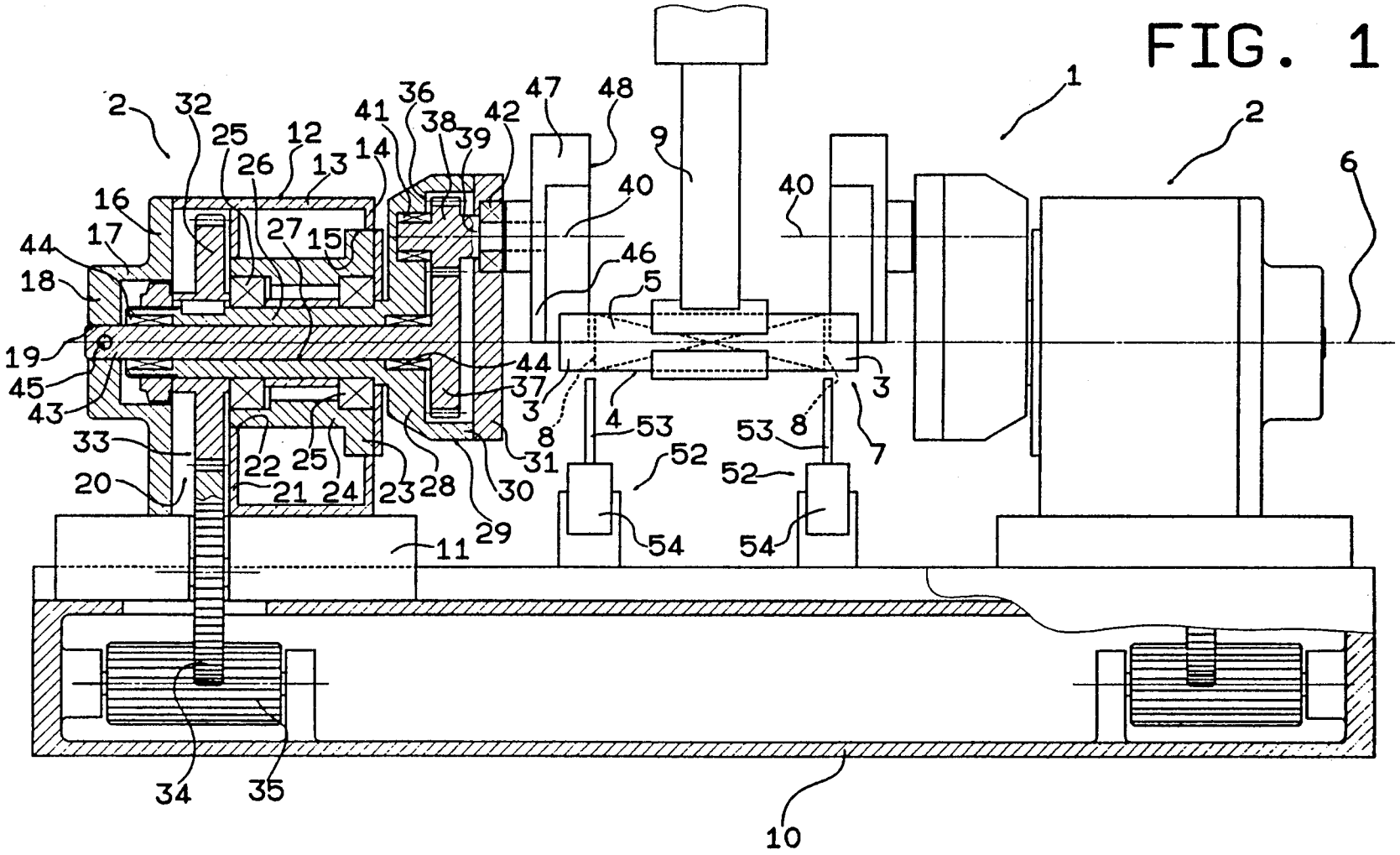
FIG. 1 is the schematic elevation, viewed partly in section, of a preferred embodiment of the folding device disclosed.

With reference to FIG. 1 of the drawings, 1 denotes a device, in its entirety, comprising two machine heads 2 positioned one facing the other and serving to gather and fold two respective terminal strips 3 of a tubular wrapper 4 enveloping a commodity 5 of elongated, and preferably cylindrical shape.

The wrapper 4, disposed about a longitudinal axis denoted 6, consists in a sheet 7 of material wound around the commodity 5; the width of the bulk sheet material (as measured along the axis denoted 6), is greater than the length of the commodity, such that the wrapper projects beyond the two end surfaces 8 of the commodity 5 to give two respective strips 3 of width generally no greater than one half the transverse dimension of the commodity 5.

The device 1 comprises a fixed holder 9 by which the enveloped commodity 5 is clenched along an intermediate part of the wrapper 4, such that the end strips 3 project unobstructed on either hand. 10 denotes a bed, disposed parallel to the wrapper axis 6 and slidably supporting two saddles 11, each one of which supports and is rigidly associated with a respective head 2.

The heads 2 are substantially identical one to the other, and accordingly, reference is made to one only in the detailed description of the construction and operation of the device, which follows.

Each head 2 comprises an essentially cylindrical housing 12, the cylindrical wall 13 of which is enclosed at the end nearest the holder 9 by a flat wall 14 lying at right angles to the wrapper axis 6 and affording a central opening 15 coaxial with the axis 6; the opposite end of the housing is enclosed by a cover 16 disposed parallel to the flat wall 14 and exhibiting a central cylindrical appendage 17, coaxial with the wrapper axis 6, that terminates in a wall 18 affording a through hole 19 smaller in diameter than the opening 15 and coaxial likewise with the wrapper axis 6.

The numeral 20 denotes a slot formed in the part of the housing wall 13 offered to the saddle 11, located between the cover 16 on the one hand, and on the other, an intermediate web 21 disposed parallel to the flat wall 14 and affording a through hole 22 coaxial with the wrapper axis 6.

The opening 15 accommodates the annular flange 23 of a cylindrical sleeve 24 that extends internally through the housing 12 to locate, by way of the end opposite from the flange 23, in the through hole 22 of the web 21. The sleeve 24 is rigidly associated with the housing 12 and provides the seat for two bearings 25 by which a hollow shaft 26, coaxial with the wrapper axis 6 and affording a through axial bore 27, is supported in rotation. A first end of the shaft 26 projects from the sleeve 24 toward the holder 9 and is rigidly associated with the rear wall 28 of a case denoted 29, this, in turn, incorporating a side wall 30 disposed parallel to the wrapper axis 6 and enclosed by a cove 31 which lies parallel with the rear wall 28 at right angles to the wrapper axis 6 and is fastened to the rim of the side wall 30 nearest the holder 9.

The remaining end of the shaft 26 carries a keyed gear 32, occupying the space between the cover 16 and the web 21, that constitutes the output member of a gear train 33 by which the hollow shaft 26 is driven in rotation; the train 33 further comprises an idle gear 34, journalled freely to the saddle 11 and rotatable about an axis parallel to the wrapper axis 6, which projects from the housing 12 through the slot 20 and meshes with the shaft gear 32 on the one hand, and on the other, with a cylindrical pinion 35 journalled to the bed 10 and driven in rotation about its own axis, which lies parallel to the wrapper axis 6, by a motor (not illustrated). The case 29 functions as rotatable planet carrier for an epicyclic train, denoted 36 in its entirety by the numeral 36, comprising a fixed sun wheel 37 and incorporating one planet wheel 38 keyed to a spindle 39 disposed with its axis 40 parallel to the wrapper axis 6 and journalled to the rear wall 28 and the cover 31 of the case 29 by way of relative bearings 41 and 42. The sun wheel 37 is coaxial with the wrapper axis 6 and associated rigidly with one end of a rod 43, carried rotatably in the bore 27 of the hollow shaft 26 by way of bearings 44, the remaining end of which locates in the hole 19 of the end wall 18 and is fixed for angular position in relation to the cover 16 by means of a radial fastener 45.

The numeral 46 denotes a disk, keyed to one end of the planet spindle 39 that projects from the cover 31 toward the holder 9, which is disposed coaxially with the planet axis 40 and substantially tangential to the wrapper axis 6. The side of the disk 46 facing the holder 9 exhibits a peripheral frontal rib 47 of essentially cylindrical embodiment, the exposed frontal surface 48 of which lies substantially in the same plane as that occupied by the relative end surface 8 of the commodity 5, encircling the planet axis 40 and extending around the periphery of the disk 46 through an arc of between 240° and 270°. More precisely, the two surfaces in question 48 and 8 are separated by a distance equivalent to three times the thickness of the wrapper 4.

Figure 2:
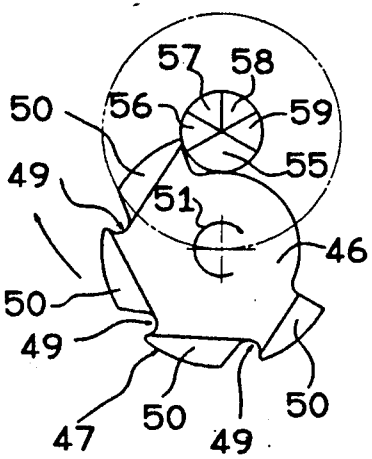
FIGS. 2 through 9 are schematic, frontal elevations of a detail of the device of FIG. 1, viewed in successive operating positions.
Figure 3:
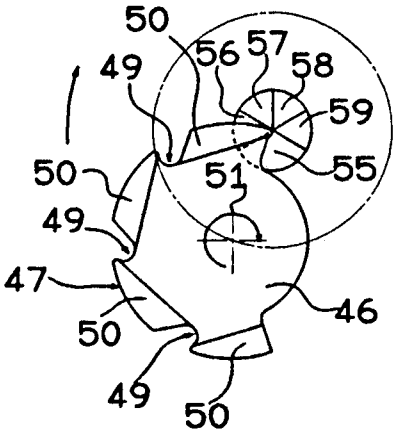
Figure 4:
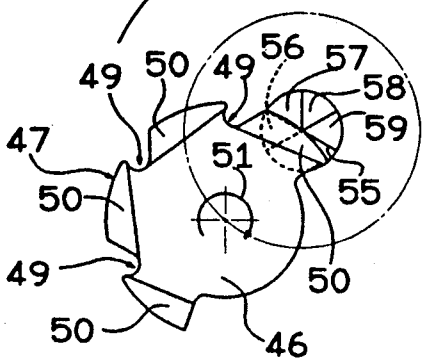
Figure 5:
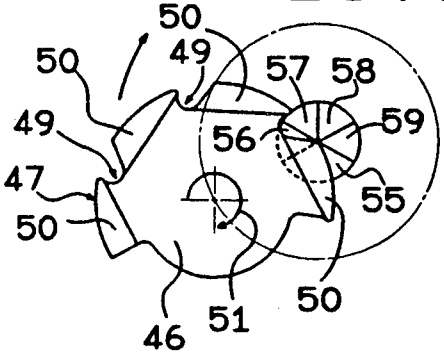
Figure 7:
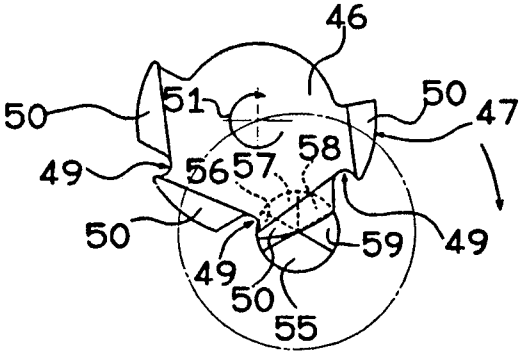
Figure 8:
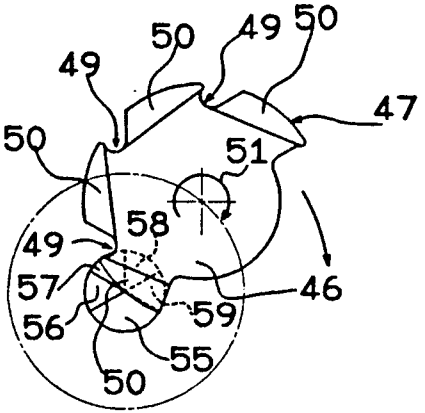

With reference now to FIG. 2 and successive figures, it will be seen that the peripheral rib 47 exhibits a plurality of axial gaps 49 by which it is divided into a plurality of wedge-shaped elements (four, in the embodiment illustrated), each constituting one folder 50 the tapered end of which is orientated in the direction of an arrow denoted 51 in FIGS. 2 through 9, which indicates the direction of rotation of the disk 46 about the planet axis 40.

Each head 2 operates in conjunction with a folding mechanism 52 of conventional embodiment, consisting in a rod 53 disposed substantially in the plane occupied by the end surface 8 of the commodity 5 and reciprocated radially in relation thereto by an actuator 54 mounted to a fixed base. The function of the reciprocating folder 50 is, at each stroke, to flatten a first portion 55 (see FIGS. 2 . . . 9) of the projecting strip 3 against the end surface 8; the remaining portions 56, 57, 58 and 59 of the strip 3 are flattened by the planetary folders 50, as will become clear in due course.

In operation of the device, with the disk 46 set in rotation about its own axis 40 and orbiting about the wrapper axis 6, the reciprocating folder 52 operates initially to flatten the first portion 55 of the projecting strip 3 against the end surface 8 of the commodity 5; more exactly, the folder 52 is actuated during the period, (illustrated in FIG. 9), in which the rimless part of the periphery of the disk 46 is offered to the projecting strip 3.

As the disk 46 continues to turn about its axis of rotation 40, in the direction of the arrow 51, and to orbit the wrapper axis 6, the tapered end of the first planetary folder 50 is brought into contact with the portion 56 of the strip 3 adjacent to the portion 55 first folded. The effect of the compound movement of the disk 46 is that the first folder 50 flattens this next portion 56, in part, directly against the surface 8, and in part into overlapped contact with the portion 55 already folded, as the tapered end describes a trajectory substantially tangential to the wrap axis 6 (FIGS. 3 through 5), and the frontal surface moves through a plane substantially tangential to the surface, thereby folding and smoothing the portion 56 against the surface 8 and the previous portion 55 at one and the same time. Observing FIGS. 3 and 4, it will be appreciated that the portion denoted 55 needs to be flattened before the planetary folders 50 enter into operation, in order that the first folder 50 can pass over the end surface 8 without encountering any unflattened part of the strip 3, which otherwise would be bent outwards or torn. Accordingly, the first portion 55 is folded through an arc of between 90° and 120° (or less than 180°, at all events), and the angle will be increased in proportion with any increase in transverse dimensions of the commodity 5.

It will be seen in FIGS. 5 through 9 how, with the disk 46 continuing to rotate and orbit, the folders 50 are brought successively into contact with the as-yet unfolded portions 57, 58 and 59 of the strip 3, and proceed to flatten them one by one, in part against the end surface 8 of the commodity 5, and in part into overlapping contact with the portion flattened immediately beforehand; similarly, it will be seen how each folder 50 quits the surface 8 at a point on the periphery occupied by a already folded part of the strip 3.

The procedure continues thus until the strip 3 has been folded down entirely over the end surface 8 of the commodity 5.

Figure 9:
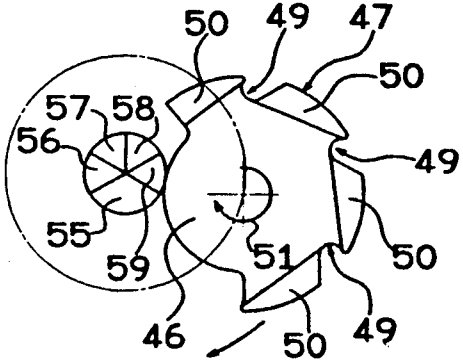
Figure 6:
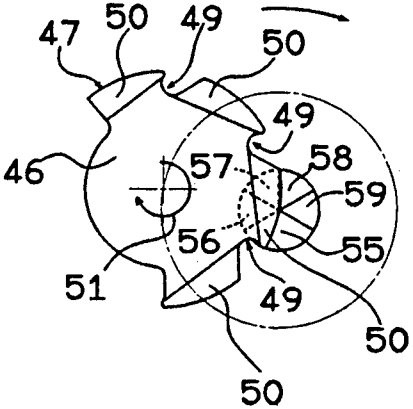

There follows an interval between the positions of FIG. 9 and FIG. 2 during which to remove the folded package (either by separation from the holder 9 or substitution of the holder itself), both terminal strips 3 of the wrapper 4 having been flattened against the relative end surfaces 8, and replace it with another commodity enveloped in a wrapper 4 of which the end strips 3 are as yet unfolded.

It will be observed that the semi-wrapped commodity can be brought into the station, prior to folding the portions denoted 56, 57, 58 and 59, with the first portion 55 already having been flattened down by folders 52 operating in a location remote from the planetary folders 50.

What is claimed:

1. A method of folding an endmost projecting strip of a tubular wrapper into contact with a corresponding end surface of a commodity convolutely enveloped by the wrapper about a longitudinal axis of the wrapper, comprising the steps of:

(a) utilizing a first folding device to flatten a first portion of said projecting strip against said end surface of said commodity in such a way as to cover an area of said end surface extending through an angle less than 180° around a first axis that coincides with said longitudinal axis of the wrapper;

(b) flattening a succession of further portions of said projecting strip against said end surface, utilizing a plurality of respective second folding devices distributed about a second axis on a common support that is separate from said first folding device, said second axis being parallel to said longitudinal axis and coinciding with an axis of rotation of said support, by which the second folding devices are carried in a position facing said end surface of the commodity in such a way as enables said second folding devices to be brought singly and successively into contact with said further portions of the projecting strip by causing said support to simultaneously rotate about said second axis one and continuous complete revolution for each time that step (a) is conducted, and to orbit about said longitudinal axis with at least one second folding device remaining in contact with said projecting strip against said end surface of said commodity through step (b).

2. A method as in claim 1, wherein:

the area of said end surface covered by said first folded portion extends through an angle of between 90° and 120°.

3. A method as in claim 1, wherein:

each of said second folding device is taken by said support through a trajectory tangential to said longitudinal axis.

4. A method as in claim 3, wherein:

a trajectory followed by the second folding device is contained within a plane perpendicular to said longitudinal axis and substantially tangential to said end surface of said commodity.

5. A method as in claim 4, wherein:

said support is invested with rotary and orbiting movement by inducing rotation, tangential to said longitudinal axis, of a planet carrier of an epicyclic train comprising a fixed sun wheel coaxial with said longitudinal axis, and a planet wheel disposed coaxial with said second axis and rigidly associated with said support.

6. A device for folding an endmost projecting strip of a tubular wrapper into contact with a corresponding end surface of a commodity convolutely enveloped by the wrapper about a longitudinal axis of the wrapper, comprising:

(a) first folding means serving to flatten a first portion of said endmost projecting strip against said end surface of said commodity in such a way as to cover an area of said end surface extending through an angle of at least 90° and less than 180° around a first axis, coinciding with said longitudinal axis of the wrapper;

(b) a plurality of second folding means serving to flatten a succession of respective further portions of said projecting strip against said end surface;

(c) a moving support disposed, separate from said first folding means, facing said projecting end of said wrapper and carrying all of said second folding means, said second folding means being distributed around a second axis which is parallel to said first axis and directed toward said end surface of said commodity;

(d) drive means by which said support is caused both to rotate about the second axis one and continuous complete revolution for each time a first portion is flattened by said first folding means and, simultaneously therewith, to orbit about said first axis with at least one said second folding device remaining in contact with said projecting strip against said end surface of said commodity from when a first until when a last said further portions is flattened against said end of said commodity.

7. A device as in claim 6, wherein the area of the end surface covered by the first folded portion extends through an angle of between 90° and 120°.

8. A device as in claim 6, wherein:

said support comprises a disk disposed coaxially with said second axis, and the second folding means are mounted on said disk and distributed around an outer periphery of the disk.

9. A device as in claim 8, wherein:

said disk is disposed substantially tangential to said first axis.

10. A device as in claim 9, wherein:

each of said second folding means comprises an element of wedge-shaped embodiment projecting radially outwardly from the disk toward said end surface of said commodity, of which element, an exposed frontal surface occupies substantially a same plane as that occupied by said end surface.

11. A device as in claim 10, wherein:

said drive means comprise an epicyclic train comprising a fixed sun wheel coaxial with said first axis, a further drive means, a rotatable planet carrier set in rotation about said first axis by said further drive means, and a planet wheel disposed coaxial with said second axis and rigidly associated with said disk.

* * * * *